US007486012B2

(12) United States Patent
Jung et al.

(10) Patent No.: US 7,486,012 B2
(45) Date of Patent: Feb. 3, 2009

(54) ELECTRON EMISSION DEVICE WITH AUXILIARY ELECTRODE AND MANUFACTURING METHOD THEREOF

(75) Inventors: Kyu-Won Jung, Suwon-si (KR); Seong-Yeon Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 617 days.

(21) Appl. No.: 10/996,761

(22) Filed: Nov. 22, 2004

(65) Prior Publication Data

US 2005/0116610 A1 Jun. 2, 2005

(30) Foreign Application Priority Data

Nov. 29, 2003 (KR) ..... 10-2003-0086105

(51) Int. Cl.
*H01J 1/62* (2006.01)
*H01J 63/04* (2006.01)

(52) U.S. Cl. ..... 313/495; 313/496; 313/310; 313/346 R

(58) Field of Classification Search ..... 313/495–497, 313/309–311, 336, 346 R, 351
See application file for complete search history.

(56) References Cited

U.S. PATENT DOCUMENTS

| | | | | |
|---|---|---|---|---|
| 6,066,922 | A * | 5/2000 | Iwasaki et al. | 315/169.3 |
| 6,316,873 | B1 * | 11/2001 | Ito et al. | 313/496 |
| 6,359,383 | B1 | 3/2002 | Chuang et al. | |
| 6,400,070 | B1 * | 6/2002 | Yamada et al. | 313/310 |
| 6,436,221 | B1 | 8/2002 | Chang et al. | |
| 7,034,448 | B2 * | 4/2006 | Lee et al. | 313/495 |
| 7,161,285 | B2 * | 1/2007 | Okamoto et al. | 313/311 |

* cited by examiner

*Primary Examiner*—Karabi Guharay
*Assistant Examiner*—Kevin Quarterman
(74) *Attorney, Agent, or Firm*—Christie, Parker & Hale, LLP

(57) ABSTRACT

An electron emission device includes a first substrate and a second substrate provided opposing one another with a predetermined gap therebetween. A first electrode is formed on the first substrate. A second electrode is formed on the first substrate crossing the first electrode. Each second electrode includes an auxiliary electrode and a main electrode formed to a thickness that is less than a thickness of the auxiliary electrode. An insulation layer is interposed between the at least first electrode and second electrodes. At least one anode electrode is formed on the second substrate; and phosphor layers are formed on one surface of the at least one anode electrode.

10 Claims, 6 Drawing Sheets

ELECTRON EMISSION DEVICE WITH AUXILIARY ELECTRODE AND MANUFACTURING METHOD THEREOF

CROSS-REFERENCE TO RELATED APPLICATIONS

This application claims priority to and the benefit of Korean Patent Application No. 2003-0086105 filed on Nov. 29, 2003 in the Korean Intellectual Property Office, the entire content of which is incorporated herein by reference.

BACKGROUND OF THE INVENTION (a) Field of the Invention

The present invention relates to an electron emission device, and more particularly, to an electron emission display device and a manufacturing method thereof in which the electron emission display device includes emitters made of a nano-size material, and gate electrodes for controlling electron emission.

(b) Description of the Related Art

In recent times, much research is being performed in the area of thick-layer processes, such as screen printing, to form electron emission regions. The electron emission regions are formed using a nano-size material that emits electrons at low voltage driving conditions of 10-100V.

Nano-size materials suitable for forming the emitters include Carbon Nano Tube (CNT) Graphite Nano Fiber (GNF), and Nano Wire. Among these, CNT appear to be very promising for use as emitters because they are able to emit electrons in low electric field conditions of about 1-10V/μm.

Examples of conventional electron emission devices utilizing carbon nanotubes and their manufacturing methods are disclosed in U.S. Pat. Nos. 6,359,383 and 6,436,221.

When the electron emission devices employ a triode structure of cathode electrodes, an anode electrode, and gate electrodes, they can have the type of well-known configuration shown in FIG. 5. With reference to FIG. 5, gate electrodes 3 are formed on rear substrate 1. Insulation layer 5 is formed on gate electrodes 3. Then cathode electrodes 7 are formed on insulation layer 5. Emitters 9 are formed on insulation layer 5 and cathode electrodes 7. Formed on front substrate 11 are anode electrode 13 and phosphor layers 15. Cathode electrodes 7 are formed of metal thin layer, for example, chrome (Cr) aluminum (Al) or molybdenum (Mo) with a thickness of 2,000-4,000 Å.

With the use of the above configuration, there is no possibility of short circuits occurring between gate electrodes 3 and cathode electrodes 7. Also, by forming emitters 9 on an uppermost layer of rear substrate 1, a thick-layer process such as screen printing may be easily performed. These factors make manufacture relatively simple, and are advantageous when producing large display devices.

However, cathode electrodes 7 made of the metal thin layer as described above have several problems. To begin with, when performing driving by applying a high voltage to anode electrode 13, arc discharges may occur in the display device. In this case, cathode electrodes 7 formed using the metal thin films may be damaged by such arc discharges. In addition, in large display devices, it is necessary that a resistance of cathode electrodes 7 be extremely small in order to realize moving images and multiple grays. However, there are limits to reducing the resistance of cathode electrodes 7 made of the metal thin films (they now have a resistance value of 3-5 Ω/□).

A conductive thick-layer material, which is not damaged by arc discharges and has a low resistance, has been considered as an alternative to metal thin films. However, fine patterning as when using metal thin films is not possible with conductive thick-layer material. Also, a thick-layer material limits the ability to increase resolution. Furthermore, since conductive thick-layer material is not resistant to acid, removal of a sacrificial layer (not shown) using an acid etchant damages the thick-layer material.

Therefore, when the cathode electrodes are formed using a metal thin layer, a method is typically used in which the cathode electrodes are more thickly formed to reduce resistance. However, a significant amount of time is required to perform this method and the remainder of the processes for forming the electrodes. Also, the problem of the electrodes becoming damaged remains.

SUMMARY OF THE INVENTION

In one exemplary embodiment of the present invention, there is provided an electron emission device and a manufacturing method thereof in which damage to cathode electrodes during arc discharges is minimized, and a resistance value of the cathode electrodes is reduced to thereby allow for the easy realization of moving images and multiple grays.

An electron emission device includes a first substrate and a second substrate provided opposing one another with a predetermined gap therebetween; first electrode formed on the first substrate; second electrode formed on the first substrate being crossed the first electrode, each second electrode including an auxiliary electrode and a main electrode formed to a thickness that is less than a thickness of the auxiliary electrode; an insulation layer interposed between the at least first electrode and second electrodes; at least one anode electrode formed on the second substrate; and phosphor layers formed on one surface of the at least one anode electrode.

The electron emission regions electrically connected to the second electrodes.

The second electrodes have a resistance of 10-20 mΩ/□.

The main electrodes of the second electrodes cover the auxiliary electrodes, and a thickness of the auxiliary electrodes is 1-5 μm.

The main electrodes of the second electrodes are formed of at least two stacked layers, and the two layers are made of different metals.

Select portions of one long edge of each of the main electrodes are removed to thereby form emitter receiving segments, and the electron emission regions are positioned in the emitter receiving segments.

The field emission display device further includes counter electrodes mounted on the insulation layer at a predetermined distance from the electron emission regions, and the counter electrodes being electrically connected to the first electrode.

Each of the counter electrodes includes a first layer, and a second layer formed on the first layer and having a thickness that is less than a thickness of the first layer.

The electron emission regions are one of nano-size material or carboneous material, carbon nano tube, graphite nano fiber, nano wire, graphite, diamond, diamond-like carbon, $C_{60}$ (Fullerene), and a combination of these materials.

A method for manufacturing an electron emission device includes forming first electrodes on a first substrate using a transparent conductive material; forming an insulation layer on the first substrate covering the first electrodes by depositing a transparent dielectric material; forming auxiliary electrodes of second electrodes by printing a thick-layer electrode material on the insulation layer; forming main electrodes of the second electrodes on the auxiliary electrodes by depositing and patterning a metal on an entire surface of the insulation layer, the main electrodes having a width greater than a width of the auxiliary electrodes; and forming emitters on the first substrate by depositing an electron emitting material on an entire surface of the first substrate, selectively hardening the electron emitting material, then developing the electron emitting material.

The forming of auxiliary electrodes includes printing a silver (Ag) paste, then drying and sintering the silver paste. The forming of main electrodes includes depositing a metal selected from the group consisting of chrome (Cr), aluminum (Al), and molybdenum (Mo), and patterning the metal.

The method further includes forming a sacrificial layer, and patterning the sacrificial layer to form openings where the emitters are to be positioned, in which the forming and patterning of the sacrificial layer is performed between forming main electrodes and forming emitters. In this case, the forming of emitters includes depositing the electron emitting material on an entire surface of the sacrificial layer, irradiating ultraviolet rays onto the first substrate from an outside surface thereof to selectively harden the electron emitting material, and removing portions of the electron emitting material that is hardened by performing developing.

The forming of an insulation layer further includes forming vias in the insulation layer, and the forming of auxiliary electrodes further includes filling a thick-layer electrode in the vias to thereby form first layers of counter electrodes in the vias. Also, the forming of main electrodes of the cathode electrodes further includes patterning a metal layer so that portions of the metal layer are left remaining on the first layer of the counter electrodes to thereby form second layers of the counter electrodes.

DETAILED DESCRIPTION

Figure 1:
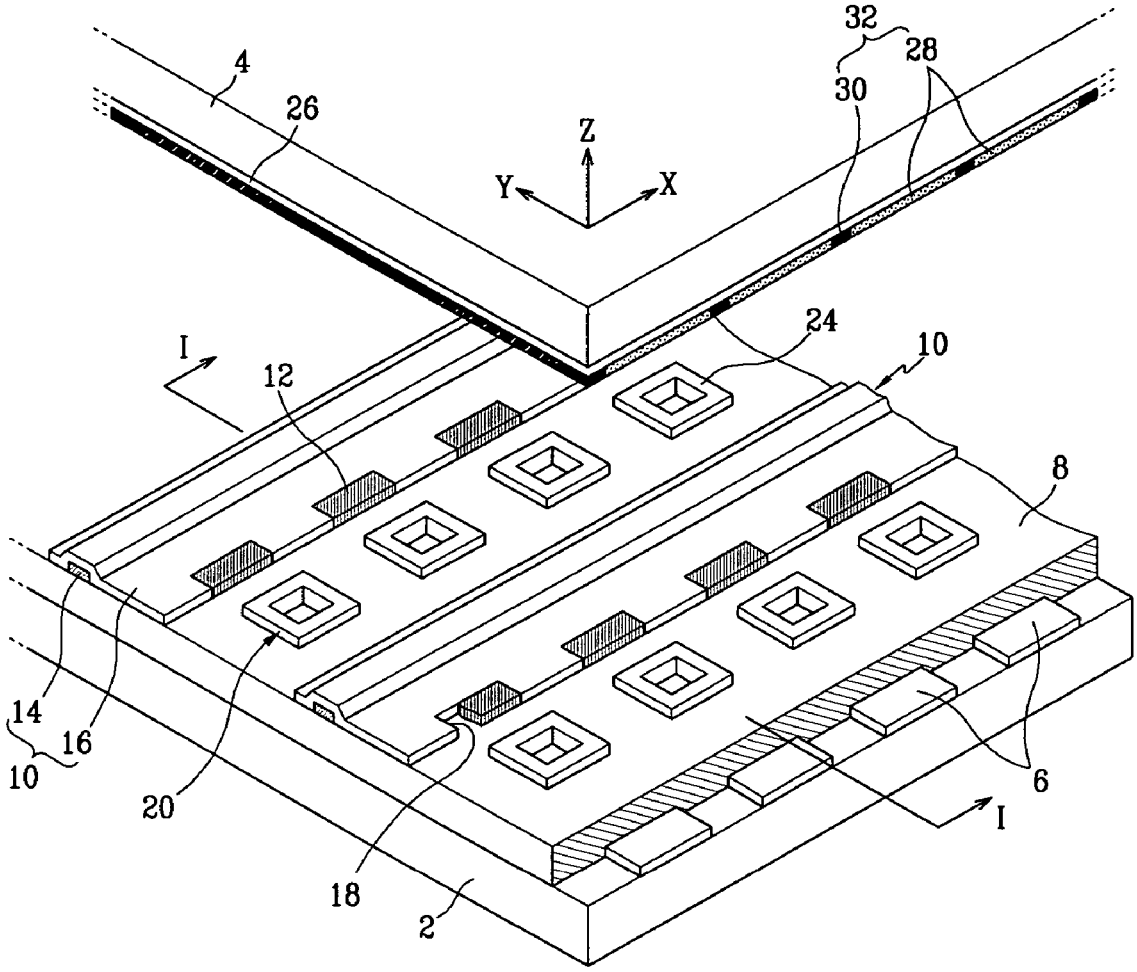
FIG. 1 is a partial exploded perspective view of a field emission display device according to an exemplary embodiment of the present invention.
Figure 2:
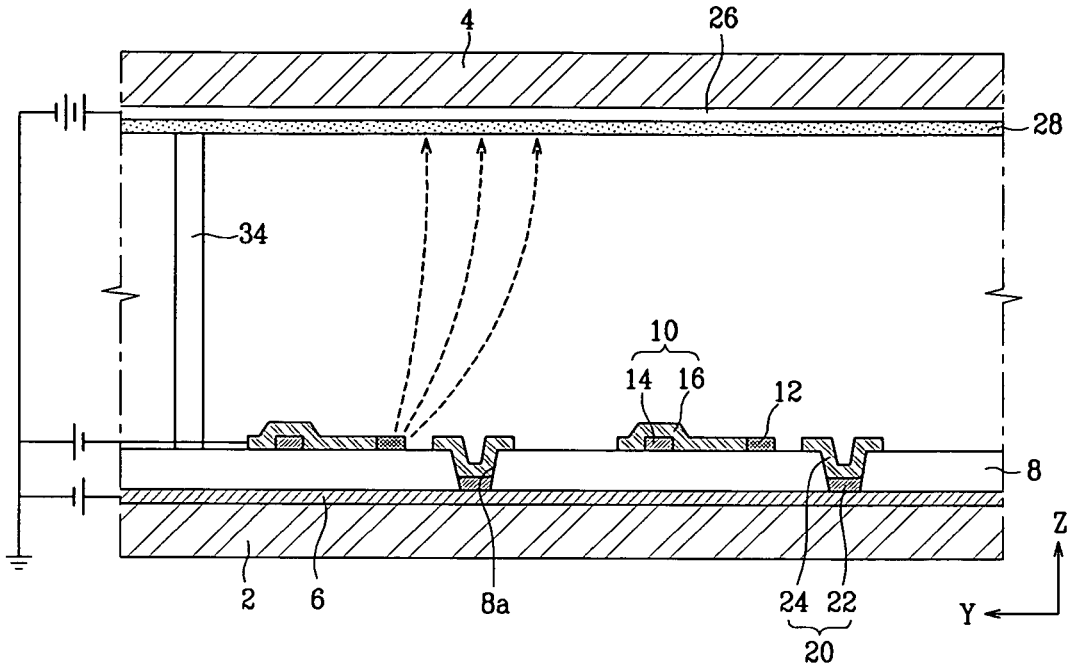
FIG. 2 is a partial sectional view of the field emission display taken along line I-I of FIG. 1, in which the field emission display is shown in an assembled state.

Referring to FIGS. 1 and 2, an exemplary embodiment of the electron emission device includes first substrate 2 and second substrate 4 provided opposing one another with a predetermined gap therebetween, thereby forming a vacuum assembly. A structure to enable the emission of electrons by the formation of an electric field is provided on first substrate 2, and a structure to enable the realization of predetermined images by interaction with emitted electrons is provided on second substrate 4.

In more detail, gate electrodes 6 are formed on a surface of first substrate 2 opposing second substrate 4. Gate electrodes 6 are formed in a stripe pattern along one direction (for example, an axis Y direction of the drawings). Further, insulation layer 8 is formed over an entire surface of first substrate 2 covering gate electrodes 6. Cathode electrodes 10 are formed on insulation layer 8 in a stripe pattern along a direction substantially perpendicular to the direction of long axes of gate electrodes 6 (for example, an axis X direction of the drawings).

Each of the cathode electrodes 10 is comprised of auxiliary electrode 14 formed of a conductive thick-layer material, and main electrode 16 formed of a metal thin-film material and to a thickness that is less than auxiliary electrode 14.

When the pixel regions of the electron emission device are defined by the regions where gate electrodes 6 and cathode electrodes 10 cross each other, emitters 12 are positioned along one long edge of main electrodes 16 contacting the same as electron emission region per the respective pixel regions.

Auxiliary electrodes 14 are films formed by performing screen printing of a metal paste such as a silver (Ag), Al, or copper (Cu) paste. Auxiliary electrodes 14 have an extremely low resistance of 10-20 mΩ/□, and prevent a reduction in a voltage of cathode electrodes 10. Main electrodes 16 are films formed by depositing and patterning a metal such as chrome (Cr), aluminum (Al), or molybdenum (Mo).

Main electrodes 16 are formed to a greater width than auxiliary electrodes 14, and are formed covering auxiliary electrodes 14. A thickness of main electrodes 16 is such to allow for full covering of auxiliary electrodes 14. The thickness of main electrodes 16 (e.g., 800-3000 Å) is less than a thickness of the auxiliary electrodes (e.g., 1-5 μm).

Predetermined areas along one long edge of main electrodes 16 are removed to thereby form emitter-receiving sections 18. Emitters 12 are positioned within emitter-receiving sections 18 in state contacting main electrodes 16. (Note: in FIG. 1 a portion of emitter 12 is cutaway from one of the emitter-receiving sections 18 to expose a portion of emitter-receiving section 18 for reference convenience.)

Figure 3:
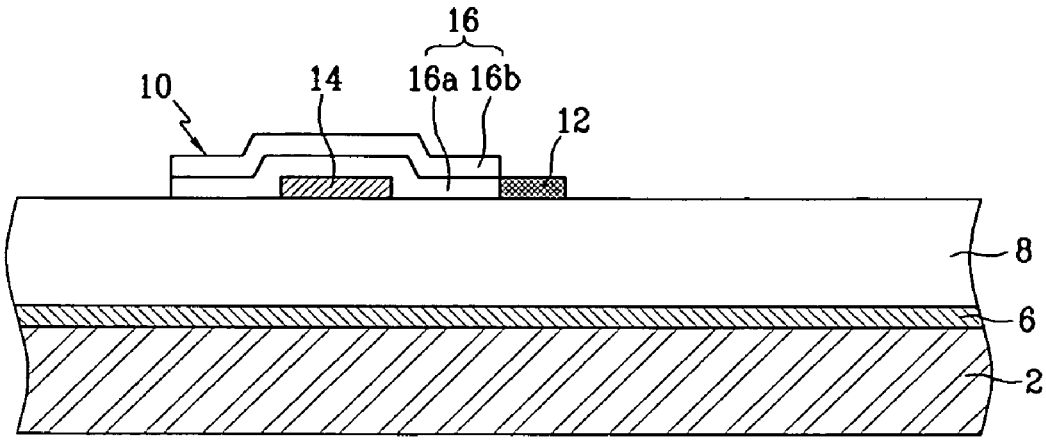
FIG. 3 is a partial sectional view of select elements of a field emission display device used to describe a cathode electrode according to another exemplary embodiment of the present invention.

Main electrodes 16 are made of a single metal layer in the exemplary embodiment of the present invention. In another exemplary embodiment, with reference to FIG. 3, main electrodes 16 are formed in a multilayer configuration. In the exemplary embodiment of FIG. 3, main electrodes 16 include first metal layer 16*a*, and second metal layer 16*b* formed on first metal layer 16*a*. In one embodiment, first and second metal layers 16*a*, 16*b* are formed of different metals having selective degrees of etching. Second metal layer 16*b* may be used as a sacrificial layer for patterning emitters 12. Second metal layers 16*b* also act to minimize damage of first metal layers 16*a* and auxiliary electrodes 14 when arc discharge occur as a result of anode electric fields of a high voltage during driving of the electron emission device.

Emitters 12 of the exemplary embodiments are electron emission sources formed to substantially identical thicknesses. In one embodiment, emitters 12 are made of a nano-size material such as carbon nanotubes, graphite nano fiber, or nano wire. Emitters 12 may also be made of a combination of these materials. Also, it is possible that emitters 12 can be made of a carbon-based material such as carbon nanotubes, graphite, diamond, diamond-like carbon, or $C_{60}$ (Fullerene). Emitters 12 may also be made of a combination of these materials.

Also formed on first substrate 2 on insulation layer 8 are counter electrodes 20. Counter electrodes 20 attract electric fields of gate electrodes 6 to an upper, exposed surface of insulation layer 8. Further, counter electrodes 20 electrically contact gate electrodes 6 by being formed to pass through vias 8*a* formed in insulation layer 8. Counter electrodes 20 are formed between cathode electrodes 10 at a predetermined distance from emitters 12. Counter electrodes 20 allow for electric fields of a greater intensity to be applied to emitters 12 and provides for better electron emission from emitters 12.

Each of the counter electrodes 20 is comprised of first layer 22 formed of a conductive thick-layer material, and second layer 24 formed of a metal thin film and that has a thickness that is less than a thickness of first layer 22. First layers 22 are filled in vias 8*a* to allow for easy formation of second layer 24, and to allow for good electrical communication between gate electrodes 6 and second layers 24.

Formed on a surface of second substrate 4 opposing first substrate 2 is anode electrode 26. Phosphor screen 32 comprised of phosphor layers 28 and black layers 30 is formed on anode electrode 26. Anode electrode 16 is made of a transparent material such as indium tin oxide (ITO).

A metal layer (not shown) may be positioned on phosphor screen 32 to increase screen brightness by providing a metal back effect. When a metal layer is provided on second substrate 4 in this manner, it is possible to use the metal layer in place of anode electrode 26. That is, anode electrode 26 need not be formed in this case.

In a state where spacers 34 are mounted between first substrate 2 and second substrate 4, a sealant (not shown) such as frit glass is used along opposing edges of first and second substrates 2, 4 to interconnect the same. Also, the air between first and second substrates 2, 4 is exhausted through an exhaust hole (not shown) to thereby complete the vacuum assembly. Further, a mesh-type grid plate (not shown) may be mounted between first and second substrates 2, 4. The grid plate acts to focus the electrons emitted from emitters 12.

In the electron emission device structured as described above, predetermined external voltages are applied to gate electrodes 6, cathode electrodes 10, and anode electrode 16 to thereby drive the electron emission device. As an example, a positive voltage of a few to a few tens of volts is applied to gate electrodes 6, a negative voltage of a few to a few tens of volts is applied to cathode electrodes 10, and a positive voltage of a few hundred to a few thousand volts is applied to anode electrode 16.

Therefore, an electric field is generated in the vicinity of emitters 12 by the difference in voltage between gate electrodes 6 and cathode electrodes 10 such that electrons are emitted from emitters 12. The electron beams formed as a result are attracted by the high positive voltage applied to anode electrode 16 to thereby land on phosphor layers 28 of the intended pixels and illuminate the same. Images are realized by selectively performing this operation throughout the electron emission device.

With the extremely low resistance of auxiliary electrodes 14 of cathode electrodes 10, a reduction in voltage of cathode electrodes 10 is minimized such that moving images and multiple gray images may be easily realized. This is the case even in large-screen electron emission devices. Further, auxiliary electrodes 14 are highly resilient such that even if main electrodes 16 become damaged by the generation of arc discharges, auxiliary electrodes 14 prevent the problem of short circuits of cathode electrodes 10. In addition, main electrodes 16 of cathode electrodes 10 allow for fine patterning such that cathode electrodes 10 and emitters 12 may be better formed to enable higher resolutions to be obtained.

A method for manufacturing the electron emission device of the present invention will now be described with reference to FIGS. 4A-4E, which are sectional views showing sequential steps involved in manufacturing the electron emission device according to an exemplary embodiment of the present invention.

Figure 4A:
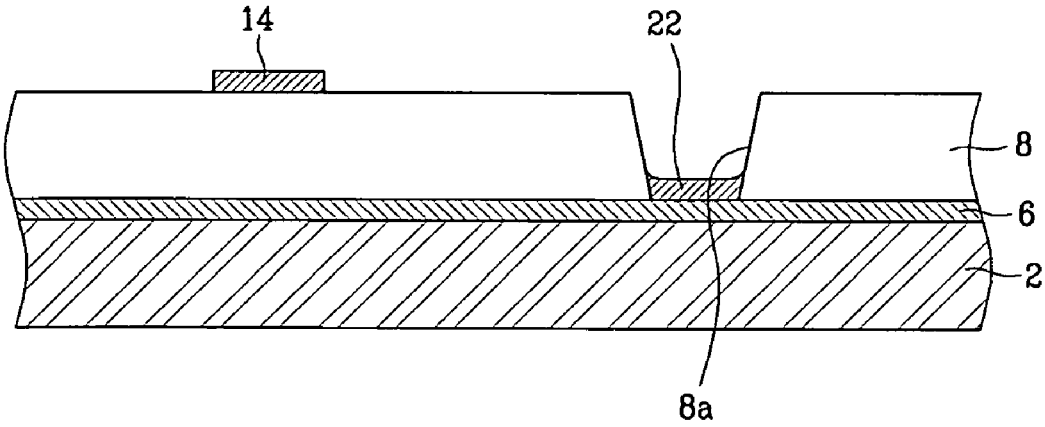
FIGS. 4A-4E are sectional views used to describe the manufacture of a field emission display device according to an exemplary embodiment of the present invention.

First, with reference to FIG. 4A, a transparent conductive material such as ITO is deposited on one surface of transparent first substrate 2 using a sputtering or coating method. The conductive material is then patterned using conventional methods to thereby form gate electrodes 6.

Next, a transparent dielectric material is printed, dried, and sintered over the entire surface of first substrate 2 on which gate electrodes 6 are formed to thereby form insulation layer 8. By repeating printing, drying, and sintering a second time, the insulation may be formed to a thickness of approximately 10-30 μm. Vias 8*a* are formed in insulation layer 8 using photolithography or wet etching methods to thereby expose gate electrodes 6. Vias 8*a* are used for the subsequent formation of counter electrodes 20, which are electrically connected to gate electrodes 6.

Further, a thick-layer electrode material such as a silver (Ag) paste is printed, dried, and sintered on insulation layer 8 to form auxiliary electrodes 14. Auxiliary electrodes 14 have a low resistance of 10-20 mΩ/□. In one embodiment, the thickness of auxiliary electrodes 14 is limited to 1-5 μm to enable main electrodes 16 (to be formed in a subsequent step) to fully cover auxiliary electrodes 14. A photosensitive thick-layer electrode material may be used as auxiliary electrodes 14, in which case the thick-layer electrode material is patterned by exposure and developed to form auxiliary electrodes 14.

When auxiliary electrodes 14 are formed using thick-layer electrode material, the thick-layer electrode material is also printed on vias 8*a* such that vias 8*a* are filled with the thick-layer electrode material. As a result, first layers 22 of counter electrodes 20 are formed in vias 8*a*. First layers 22 reduce a difference in height between second layers 24 and vias 8*a* to thereby enable the easy formation of second layers 24.

Figure 4B:
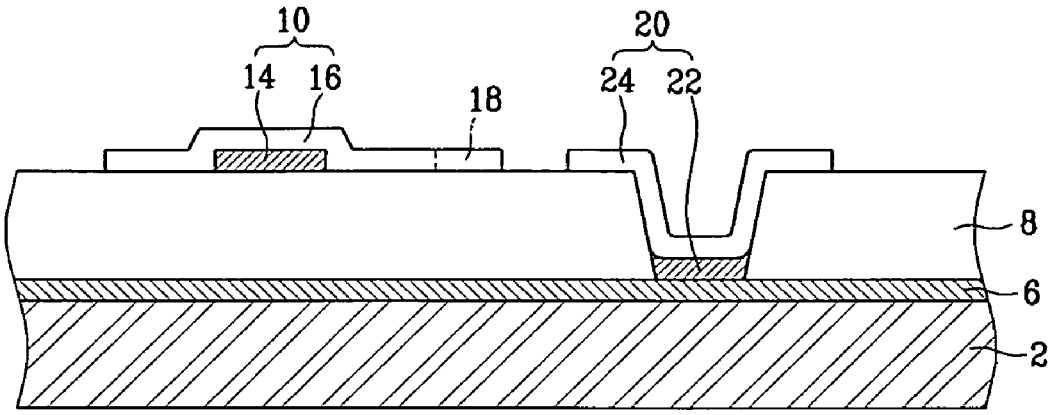

Next, with reference to FIG. 4B, a metal such as Cr, Al, or Mo is deposited on first substrate 2. The metal is then patterned using photolithography to thereby form main electrodes 16 on auxiliary electrodes 14, and second layer 24 on first layer 22. Therefore, cathode electrodes 10 comprised of main electrodes 16 and auxiliary electrodes 14, and counter electrodes 20 comprised of first and second layers 22, 24, are completed.

Main electrodes 16 are formed to a greater width than auxiliary electrodes 14 to thereby completely cover auxiliary electrodes 14. This prevents damage to auxiliary electrodes 14 by a sacrificial layer etchant used during removing of a sacrificial layer formed in a subsequent step. During patterning of main electrodes 16, emitter receiving segments 18 are formed as shown in FIG. 1 along one long edge of main electrodes 16, that is, the edges of main electrodes 16 opposing counter electrodes 20.

Figure 4C:
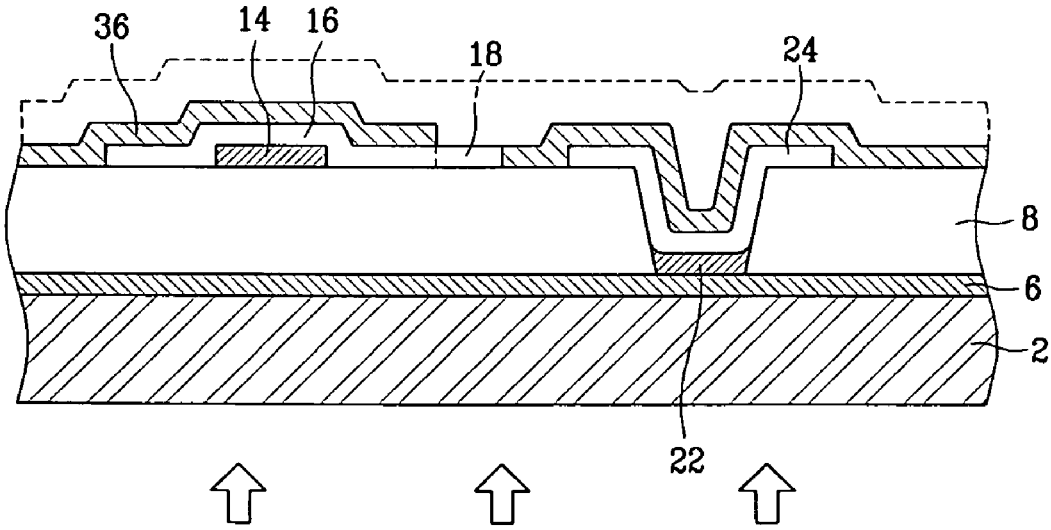

Subsequently, with reference to FIG. 4C, a metal material is deposited over all exposed elements formed on first substrate 2, after which patterning is performed through photolithography to form sacrificial layer 36 having openings corresponding to locations of emitter receiving segments 18. A different metal than that used for main electrodes 16 is used for sacrificial layer 36. For example, if Cr is used for main electrodes 16, Al may be used for sacrificial layer 36.

Next, a photosensitive electron emission material in the form of a paste is screen printed on all exposed elements of first substrate 2. In one embodiment, a photosensitive electron emission material having as its main component carbon nanotubes may be screen printed. Ultraviolet rays are then irradiated through a rear surface of first substrate 2 to selectively harden the electron emission material filled in the emitter receiving segments 18. Electron emission material that is not hardened is removed by performing developing to thereby form emitters 12 to a thickness of a few micrometers (μm). Completed emitters 12 are shown in FIG. 4D.

Subsequently, all of sacrificial layer 36 is removed using a sacrificial layer etchant to thereby result in the configuration shown in FIG. 4D. Alternatively, if not all of the sacrificial layer 36 is removed and instead is selectively left remaining on main electrodes 16 and second layer 24, the configuration shown in FIG. 4E results. In FIG. 4E, main electrodes 16 of cathode electrodes 10 have a stacked structure comprised of first and second metal layers 16*a*, 16*b*, and second layer 24 of counter electrodes 20 have a stacked structure comprised of first and second metal layers 24*a*, 24*b*.

Figure 4D:
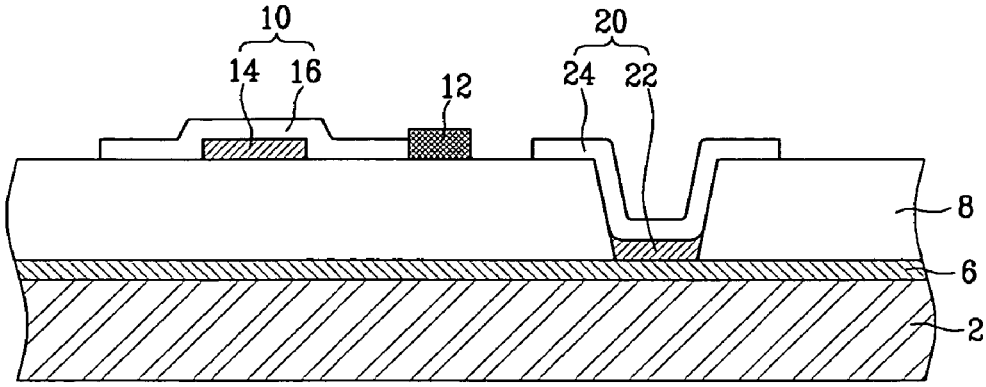
Figure 4E:
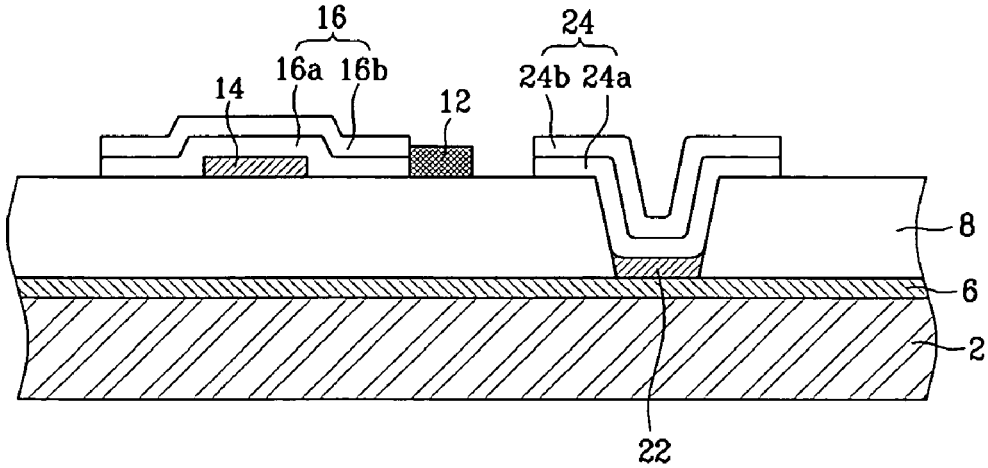
Figure 5:
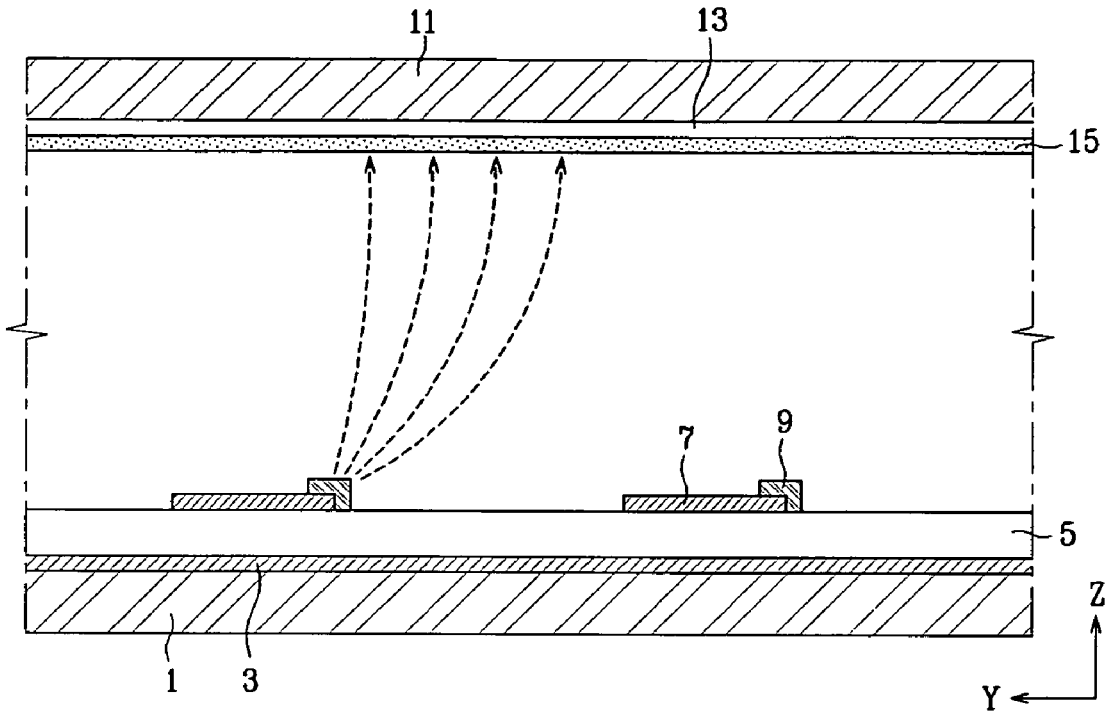
FIG. 5(Prior Art)
FIG. 5 is a partial sectional view of a conventional field emission display.

Following the formation of the structure of either FIG. 4D or FIG. 4E, spacers 34 (as seen in FIG. 2) are fixed on first substrate 2. Next, following the formation of anode electrode 26 and phosphor screen 32 on second substrate 4 as shown in FIG. 1, a sealant is applied to opposing edges of first and second substrates 2, 4 to thereby interconnect first and second substrates 2, 4. The air between first and second substrates 2, 4 is then evacuated, thereby completing the FED device.

In the above, a configuration in which gate electrodes 6 are striped and anode electrode 26 is formed over the entire inner surface of second substrate 4 is described. However, the present invention is not limited in this regard and it is possible to form a gate electrode over the entire inner surface of the first substrate 2, and anode electrodes and cathode electrodes in striped patterns along perpendicular directions.

In the electron emission device of the present invention structured as described above, the auxiliary electrodes of the cathode electrodes have an extremely low resistance. Therefore, a reduction in voltage of the cathode electrodes is minimized to allow for easy realization of moving images and multiple grays, even when the electron emission device is made to a large size. Further, even if the main electrodes are damaged as a result of arc discharges within the vacuum assembly, the auxiliary electrodes, which are highly resilient, prevent the short circuiting of the cathode electrodes. Also, the main electrodes, which are made of metal thin films, allow for the fine patterning of the cathode electrodes and the emitters. This aids efforts at obtaining high-resolution images.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. An electron emission device, comprising:

a first substrate and a second substrate opposing one another with a gap therebetween;

at least a first electrode on the first substrate;

at least a second electrode on the first substrate and crossing the first electrode, each second electrode including an auxiliary electrode and a main electrode having a thickness less than a thickness of the auxiliary electrode, the auxiliary electrode and the main electrode both extending lengthwise in a same direction;

an insulation layer between the at least a first electrode and the at least a second electrode;

at least one anode electrode on the second substrate; and phosphor layers on one surface of the at least one anode electrode, wherein the main electrode of the second electrode covers the auxiliary electrode.

2. The electron emission device of claim 1, wherein an electron emission region is electrically connected to the second electrode.

3. The electron emission device of claim 1, wherein the second electrode has a resistance of 10-20 mΩ/□.

4. The electron emission device of claim 1 wherein a thickness of the auxiliary electrode is 1-5 μm.

5. The electron emission device of claim 1, wherein the main electrode of second electrode is formed of at least two stacked layers.

6. The electron emission device of claim 5, wherein the at least two stacked layers are of different metals.

7. The electron emission device of claim 1, wherein select portions of one long edge of each of the main electrode provide emitter receiving segments, and electron emission regions are positioned in the emitter receiving segments.

8. The electron emission device of claim 2, further comprising at least a counter electrode on the insulation layer at a distance from the electron emission region, the counter electrode being electrically connected to the first electrode.

9. The electron emission device of claim 7, wherein the counter electrode includes a first layer, and a second layer on the first layer and having a thickness less than a thickness of the first layer.

10. The electron emission device of claim 2, wherein the electron emission region is selected from the group consisting of carbon nanotubes, graphite, graphite nano fiber, nano wire, diamond, diamond-like carbon, C60 (Fullerene), and a combination of these materials.

* * * * *

UNITED STATES PATENT AND TRADEMARK OFFICE

CERTIFICATE OF CORRECTION

PATENT NO. : 7,486,012 B2
APPLICATION NO. : 10/996761
DATED : February 3, 2009
INVENTOR(S) : Kyu-Won Jung et al.

It is certified that error appears in the above-identified patent and that said Letters Patent is hereby corrected as shown below:

In the Claims

| | |
|---|---|
| Column 8, Claim 4, line 24 | Insert -- , -- after "1" |
| Column 8, Claim 5, line 27 | Before "second"<br>Insert -- the -- |
| Column 8, Claim 7, line 32 | Delete "electrode"<br>Insert -- electrodes -- |

Signed and Sealed this
First Day of February, 2011

David J. Kappos

David J. Kappos
*Director of the United States Patent and Trademark Office*